US006941999B2

(12) United States Patent
Paterni

(10) Patent No.: US 6,941,999 B2
(45) Date of Patent: Sep. 13, 2005

(54) ADJUSTABLE STRIP DOOR HANGER

(75) Inventor: Richard Michael Paterni, McDonald, PA (US)

(73) Assignee: TMI Incorporated, Pittsburgh, PA (US)

( * ) Notice: Subject to any disclaimer, the term of this patent is extended or adjusted under 35 U.S.C. 154(b) by 42 days.

(21) Appl. No.: 10/668,839

(22) Filed: Sep. 23, 2003

(65) Prior Publication Data

US 2005/0061453 A1 Mar. 24, 2005

(51) Int. Cl.[7] ..... E05D 15/00
(52) U.S. Cl. ..... 160/184; 160/327; 160/332
(58) Field of Search ..... 160/184, 327, 160/332, 380, 383

(56) References Cited

U.S. PATENT DOCUMENTS 4,165,778 A 8/1979 Smith ..... 160/332
4,607,678 A * 8/1986 Pomaville et al. ..... 160/332
4,635,699 A * 1/1987 Kauffman et al. ..... 160/211
5,127,460 A * 7/1992 Abadi et al. ..... 160/332
5,146,971 A * 9/1992 McCarty ..... 160/184
5,520,237 A * 5/1996 Finkelstein et al. ..... 160/184
6,050,322 A * 4/2000 Finkelstein et al. ..... 160/332
6,189,264 B1 * 2/2001 DiVeroli ..... 49/57
6,209,615 B1 * 4/2001 Whittemore ..... 160/368.1

* cited by examiner

*Primary Examiner*—Bruce A. Ley
(74) *Attorney, Agent, or Firm*—Armstrong, Kratz, Quintos, Hanson & Brooks, LLP

(57) ABSTRACT

A hanger for plastic strips having uniformity spaced apertures along an end portion thereof, to form a strip door across an opening. Uniformily spaced studs are provided on a mountable backing plate to support the plastic strips. A retaining plate retains the strips on the studs which have locking means along the length thereof, so as to provide an adjustable effective length for each of the studs.

8 Claims, 5 Drawing Sheets

ADJUSTABLE STRIP DOOR HANGER

FIELD OF THE INVENTION

The present invention relates to the field of strip doors used primarily for providing a flexible barrier across entry and exit openings in commercial and industrial facilities and equipment.

BACKGROUND OF THE INVENTION

Vertically hanging plastic strips arranged side-by-side, or in an overlapping arrangement, are used in many industrial and commercial applications to provide a flexible barrier to air, insects, noise, vapors, moisture, etc. A strip door system, which provides such barrier, only minimally disrupts the passage of product, personnel or vehicles through a doorway, or the like, as the vertically hanging plastic strips are easily bent to provide an opening for entry or exit. An important application for strip door systems, which provide a significant savings in energy consumption, is on openings into freezers and coolers in warehouse facilities, food processing areas, restaurants, etc.

Strip door systems are typically assembled by hanging a plurality of flexible plastic strips, having a width of 8–16 inches and a thickness of 0.060 to 0.160 inches, which are produced from PVC material. The strips typically are hung to span a vertically oriented plane, such as between side jams of a doorway. The strips typically have an overlap of 25–100%, for example, for a 50% overlap, on a given strip, 25% of its width, at each edge, would be overlapped with an adjacent strip.

The vertically hanging strips are usually hung from a uniformity spaced series of studs disposed at or near a header of a doorway. The studs are most often fixed to a plate, or the like, to form a hanger, and the hanger is attached to the header or a wall above the doorway. Many different hangers are known for hanging the plastic strips.

FIG. 1 shows a known flexible strip door system for describing a general configuration of a strip door system in which a hanger of the present invention would be used. In FIG. 1, an opening 1 in wall 2 is provided with a flexible plastic strip door 3 having elongated flexible plastic strips 4 arranged in an overlapping pattern with areas of overlapping indicated at 5. The strips 4 are hung from a hanger 6 having protruding studs 7 arranged in a uniform spacing along the length of the hanger. The plastic strips 4 have uniformily spaced apertures 8, along an upper portion, which correspond in spacing with the studs 7 of the hanger. The spacing arrangement of the studs and the apertures allow for overlap of 25 to 100%, or no overlap, wherein edges of the strips are placed abutting edges of adjacent strips.

The system depicted in FIG. 1 has an overlap of about 50%, that is 50% of each strip is overlapped by other strips. Although not shown, some type of retaining device is necessary to prevent the strips from sliding off the studs when the strips are encountered by personnel or equipment passing through the opening. In U.S. patent application Ser. No. 10/406,527 entitled "Flexible-Strip Hanger for a Strip Door System and Method of Making Same", filed Apr. 3, 2003, a hinged cover prevents the plastic strips from sliding off the studs.

Plastic strip door systems, as described above are very durable as they can be subjected to heavy usage by personnel or equipment passing through them. In particular, fork lifts or other commercial and industrial type equipment often subject the plastic strips to harsh usage, including tearing away of the strips, if caught on such equipment or caught on the product being moved. Such harsh usage, as well as normal everyday usage, necessitates the plastic strips being replaced from time to time. Because of the typical locations of the hangers, that is at a location requiring the use of a ladder, and/or at cold or below freezing environments, replacement is often difficult and dangerous, and can require the use of more than one person to carry out the replacement.

One known hanger has spaced studs on a backing plate along with a strip retaining bar, which requires the use of tools to secure the bar in place. Another known hanger, although it requires no tools for installing the strips, relies solely on studs having an enlarged end to prevent the strips from sliding off. In such a system an aperture in the plastic strip, which slides over the stud, must be very accurately formed so as to fit over the stud, yet be retained by the enlarged end. In the same system, a strip having the properly sized aperture can be difficult to slide over the enlarged end, if the material of the strip is at a low temperature in a cooler or freezer application. Many retaining systems are known, however they all have undesirable features.

OBJECTS OF THE INVENTION

It is the object of the present invention to provide a hanger for plastic strips of a strip door system which is of durable construction and configured for convenient initial installation.

It is another object of the present invention to provide a hanger which enables easy replacement of worn or damaged plastic strips, without the use of hand tools.

It is still another object of the present invention to provide a hanger having a positive retaining device to prevent the plastic strips from sliding off the studs, which does not rely solely on an enlarged portion of a stud and the elasticity of the plastic strip.

It is yet a further object of the present invention to provide an adjustable effective stud length to better accommodate plastic strips of various thicknesses arranged to have various amounts of overlap.

SUMMARY OF THE INVENTION

The present invention is a hanger for use in a strip door system for supporting vertically hanging flexible plastic strips, wherein each strip has a row of uniformily spaced apertures along an upper end portion. The hanger has an elongated backing plate portion for attaching the hanger to a structure above an opening, a plurality of uniformily spaced studs fixed along the length of the backing plate, for supporting the plastic strips by engagement through the strip apertures, and an elongated retaining plate for locking with the studs to prevent the engaged strips from sliding off the studs. Each stud has a plurality of locking grooves along its length for locking the retaining plate with the studs so as to provide an adjustable effective stud length between the backing plate and the retaining plate .

BRIEF DESCRIPTION OF THE DRAWINGS

The invention will become more readily apparent from the following description of preferred embodiments thereof, shown, by way of example only, in the accompanying drawings, wherein.

DETAILED DESCRIPTION OF THE INVENTION

Figure 1:
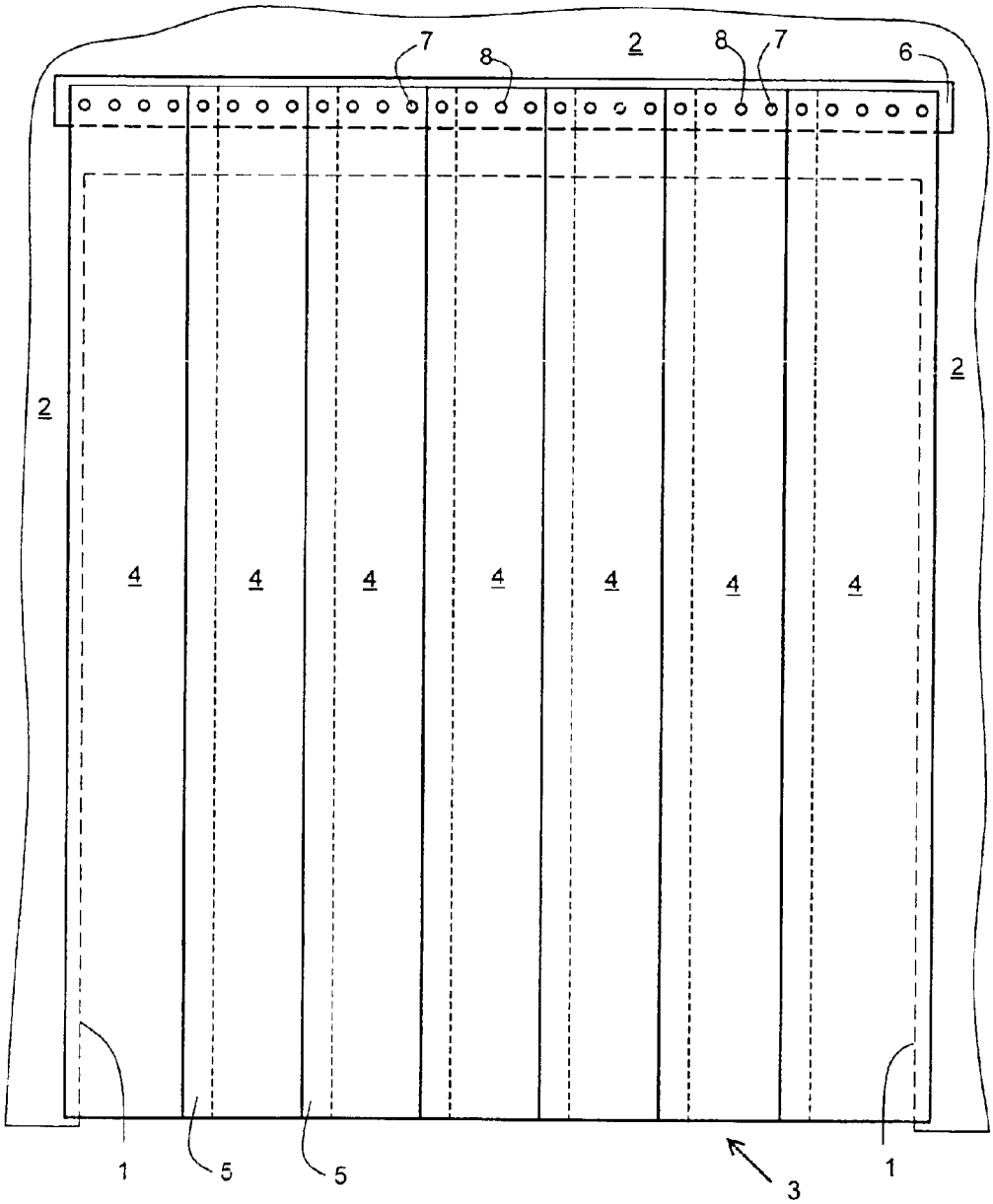
FIG.1 Prior Art
FIG. 1 is a prior-art strip door system wherein flexible plastic strips having uniformily spaced apertures are supported on a hanger having uniformily spaced protruding studs.
Figure 2A:
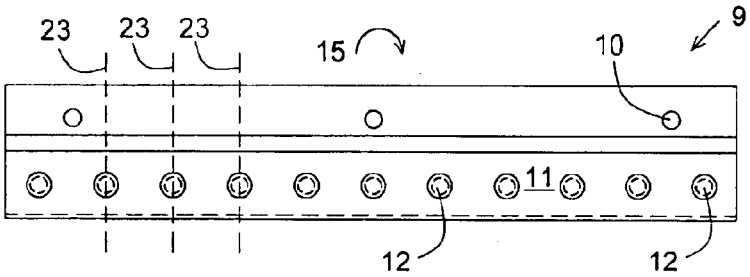
FIGS. 2A and 2B are respectively, a front view and an end view of a backing plate of a first embodiment of the invention.
Figure 2B:
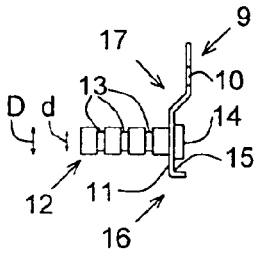

FIGS. 2A and 2B show a front view and an end view, respectively, of an elongated backing plate of the first embodiment of the invention. The three embodiments of the invention, discussed below, are distinct only in the shape of the backing plate which is provided for mounting: 1) on a vertically oriented wall above an opening, 2) on a horizontally oriented header of an opening, and 3) on either a vertically oriented wall or a header of an opening.

The first embodiment, shown in FIGS. 2A and 2B, is for use in mounting on a wall above an opening which is to be provided with a strip door system. Shown is an elongated backing plate 9 of the hanger having apertures 10 for attaching the hanger to a vertically oriented wall above an opening to which the strip door is to be installed. Protruding from a front face 11 of the backing plate are a plurality of uniformily spaced studs 12 for supporting the flexible plastic strips of the strip door system. Apertures provided along a top portion of each strip are slid over the uniformily spaced studs to install the strips on the hanger. The studs, which preferably have a cylindrical shape, feature annularly shaped grooves 13 spaced along the length of each stud. The grooves have a major diameter D which corresponds to the surface of the stud, and a minor diameter d as measured at the base of a groove. To insure a tight attachment to the backing plate, the studs preferably extend through the backing plate 9 and have a head portion 14 which rests against back face 15 of the backing plate. Any known method, such as a press fit, brazing, or the like, can be used to maintain a tight attachment of the studs to the backing plate. Preferably the backing plate includes bent portions, such as at 16 and 17 to give rigidity to the backing plate and to provide a spacing for the head portions 14 of the studs. The hanger can be of any length required to span the opening being addressed.

Figure 3A:
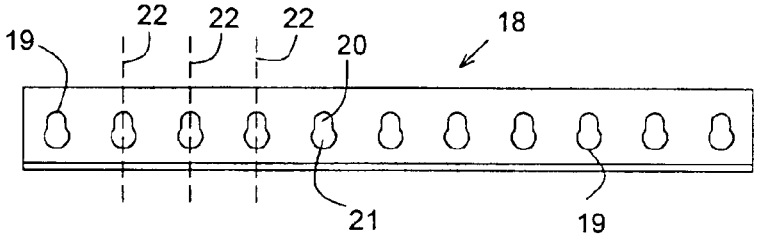
FIGS. 3A and 3B are respectively, a front view and an end view of a retaining plate of the invention.
Figure 3B:
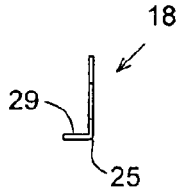

FIGS. 3A and 3B show an elongated retaining plate 18 of the hanger which prevents the installed flexible plastic strips from sliding off studs 12. Retaining plate 18 features apertures 19, having a minor portion 20, and a major portion 21 which communicate with each other. Apertures 19 have centerlines 22 which correspond in spacing with center lines 23 of the studs of backing plate 9. The apertures 19 of retaining plate 18 are configured such that the major portion of the aperture is slideable along the length of the studs, and the minor portion is slideable into one of the grooves 13, but not slideable along the length of the stud. Thus the grooves of the studs act as a locking mechanism for the retaining plate 18.

Figure 4A:
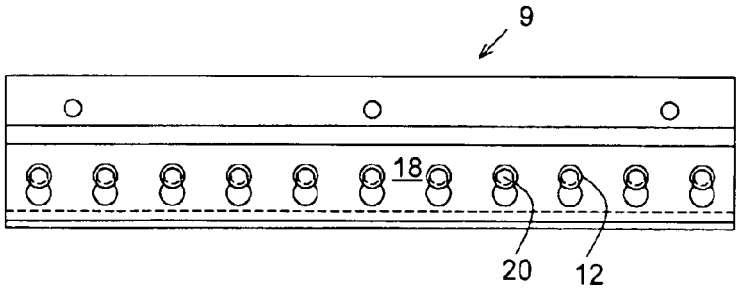
FIGS. 4A and 4B are respectively, a front view and an end view of the backing plate of FIGS. 2A and 2B, having the retaining plate of FIGS. 3A and 3B in an engaged position.
Figure 4B:
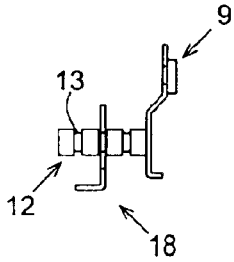
Figure 5A:
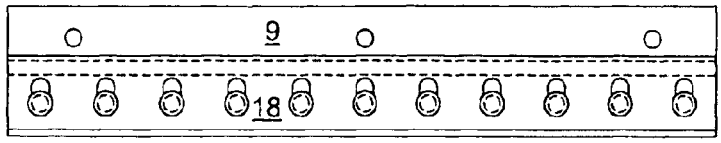
FIGS. 5A and 5B are respectively, a front view and an end view of the retaining plate of FIGS. 3A and 3B as disposed when sliding the retaining plate onto studs of the backing plate.
Figure 5B:
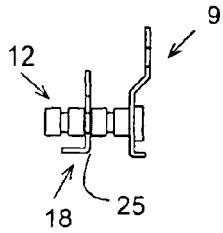

FIGS. 4A and 4B show the retaining plate 18 in an engaged position, that is minor portions 20 of the apertures are seated in the grooves 13 of the studs 12. FIGS. 5A and 5B show retaining plate 18 in a state whereat the major portion 21 of the aperture is being slid over the stud 12 to a position at which the retaining plate 18 is aligned with a groove 13 of the stud, and whereat by solely the force of gravity, the retaining plate 18 becomes locked on the stud 12 by engagement of the minor portion 20 of the aperture with the groove 13 as shown in FIGS. 4A and 4B.

Figure 6A:
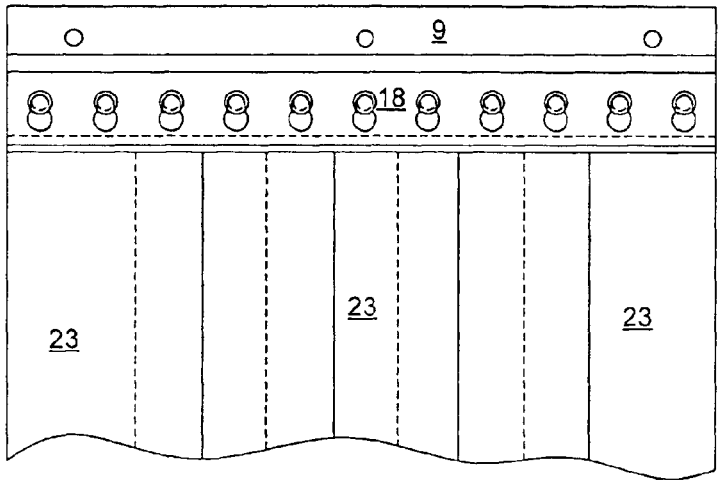
FIGS. 6A and 6B are respectively, a front view and an end view of the hanger of the first embodiment of the invention having flexible plastic strips in place on the hanger.
Figure 6B:
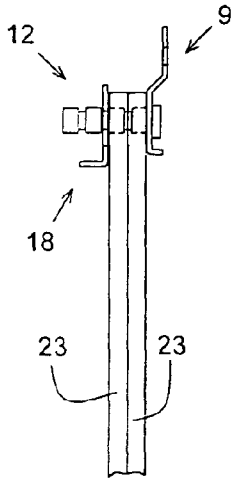

As indicated earlier, a plurality of grooves are disposed along the length of each stud. Such arrangement enables the use of various thicknesses of plastic strips in either an overlapping or non-overlapping side-by-side hanging pattern. FIGS. 6A and 6B show the hanger of the invention having plastic strips 23 hanging from the studs 12 in an overlapping arrangement. As shown in FIG. 6B, having retaining plate 18 in a selected groove 13 of the stud provides an effective stud length, as measured between the backing plate 9 and the retaining plate 18, such that the strips are prevented from moving backward and forward along the length of the stud. The spacing of the grooves need not be uniform along the length of the stud, however all of the studs of a hanger must have the same groove pattern. As can be seen in FIG. 6B, if thinner or thicker plastic strips are desired, or if no overlap is desired, the various grooves provide for flexibility by enabling an adjustment of the effective length of each stud. The grooves preferably have side walls which are perpendicular to the central axis of the stud, so as to more securely hold the retaining plate. As in the backing plate 9, a bend 25 is provided in the retaining plate 18 in order to provide rigidity. When the retaining plate is engaged in the grooves 13 of the studs along the length of the hanger, normal passage through the strip door will not cause disengagement.

Figure 7A:
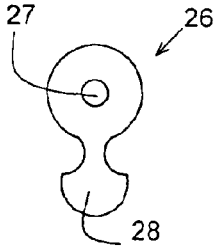
FIGS. 7A and 7B are respectively, a front view and an edge view of a retaining disc of the invention.
Figure 7B:
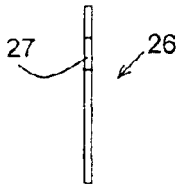
Figure 8A:
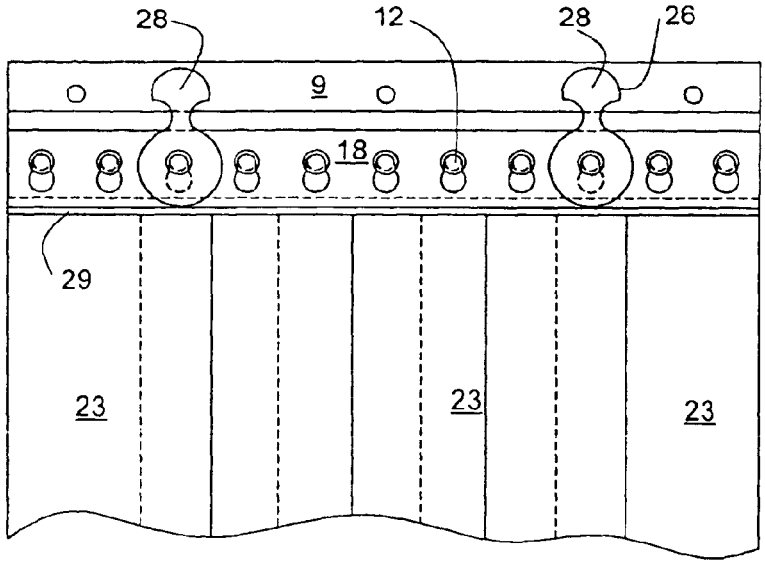
FIGS. 8A and 8B are respectively a front view and an end view of the hanger of the first embodiment of the invention having the flexible plastic strip in place on the hanger and retaining discs in place on studs of the hanger.
Figure 8B:
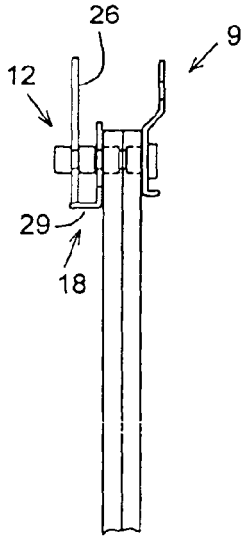

As an added safety feature, a retaining disc, 26, as shown in FIGS. 7A and 7B can be used with the backing plate 9 and the retaining plate 18. Referring to FIGS. 8A and 8B, the retaining disc 26 is shown as disposed on stud 12. The retaining disc 26 is fabricated of a material having elasticity, yet some stiffness, in order that an aperture 27 formed in the retaining disc can be slid over a stud and be retained by elastic forces in a groove of the stud, that is one of the same grooves used for the retaining plate 18. Preferably the aperture 27 is formed to have a diameter corresponding to the diameter d of the base of the groove. The disc is positioned on the stud, extending downward to contact a ridge 29 along a bottom portion of the retaining plate as shown in FIGS. 8A and 8B. Preferably the disc 26 has a thickness approximately equal to a width of the grooves to assure that the disc hangs vertically downward without a clearance between the disc and the groove with would enable easy movement of the disc away from its preferred vertical orientation. The disc 26 is placed in the groove which is adjacent to the groove occupied by the retaining plate. Also, in order to facilitate use of the retaining disc, a tab 28 extending from the body of the disc, is provided. In use of the invention, at least one of the retaining discs is used to assure that the retaining plate, due to an occurrence other than normal use of the strip door, does not move upwardly so as to become disengaged from the studs. The elimination of upwardly movement is assured by the disc 26 making contact with the ridge 29.

Figure 9A:
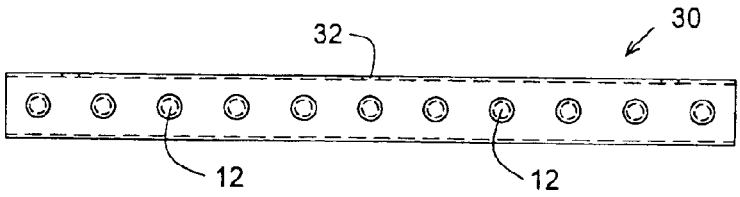
FIGS. 9A and 9B are respectively, a front view and an end view of a backing plate of a second embodiment of the invention, for use when mounting the hanger on a header.
Figure 9B:
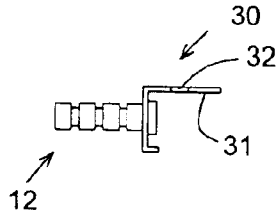

FIGS. 9A and 9B show a front view and an end view respectively of a second embodiment of the invention for use in mounting a hanger to a horizontally oriented header of a doorway, for example. Shown in FIGS. 9A and 9B is backing plate 30 having a portion 31, which is oriented horizontally when installed, which can be attached to a horizontally oriented surface for installation. Apertures 32 are provided to facilitate the installation. In the second embodiment, shown in FIGS. 9A and 9B all remaining features and operation are as described in the description of the first embodiment.

Figure 10A:
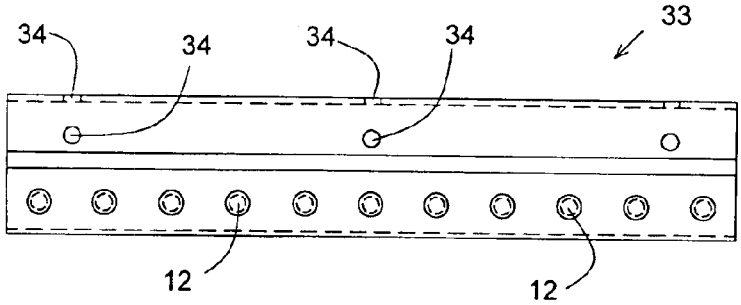
FIGS. 10A and 10B are respectively, a front view and an end view of a universal backing plate of a third embodiment of the invention, for either wall or header mounting of the hanger.
Figure 10B:
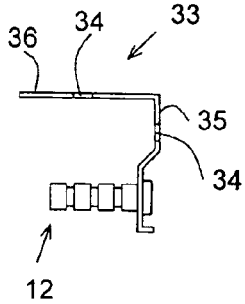

FIGS. 10A and 10B show a front view and an end view respectively of a third embodiment of the invention, which can be used for mounting the backing plate 33 to either a horizontally or vertically oriented surface. The backing plate 33 provides apertures 34 in portion 35 and web 36 of the backing plate 33. In the third embodiment, shown in FIGS. 10A and 10B, all remaining features and operation are as described in the description of the first embodiment.

In all of the embodiments of the invention, because of the typically moist environment of the installation, galvanized steel or stainless steel is the preferred material for the components, however other materials are available in practice of the invention. The backing plate and retaining plate are preferably formed of 10 to 20 gauge sheet material. The studs preferably have a diameter of ¼–⅜ inches and a length of ¾–1¼ inches. The depth of the grooves is preferably about 0.07 inch.

While specific materials, dimensional data, etc. have been set forth for purposes of describing embodiments of the invention, various modifications can be resorted to, in light of the above teachings, without departing from Applicant's novel contributions; therefore in determining the scope of the present invention, reference shall be made to the appended claims.

What is claimed is:

1. A hanger for use in a strip door system for supporting vertically hanging flexible plastic strips, each strip having a row of uniformily spaced apertures along an upper end portion, said hanger comprising an elongated backing plate portion for mounting said hanger to a structure above an opening, a plurality of uniformily spaced studs fixed along the length of said backing plate, for supporting the plastic strips by engagement of the studs through the strip apertures, and an elongated retaining plate for locking with said studs to prevent disengagement of the strips, each said stud having a plurality of locking means along its length for locking said retaining plate with said studs so as to provide an adjustable effective stud length between said backing plate and said retaining plate.

2. The hanger of claim 1, wherein said locking means comprises grooves spaced along said studs for cooperating with said retaining plate to provide said effective stud length.

3. The hanger of claim 2, further comprising at least one retaining disc of a stiff elastic material configured to have an aperture for sliding over a stud and to be retained by elastic forces when disposed in a groove of the stud, for preventing upward movement of said retaining plate from said retaining position by said retaining disc contacting said retaining plate.

4. The hanger of claim 1, wherein each stud is cylindrically shaped with a plurality of annularly shaped grooves spaced along the length of the stud, said annular grooves having a major diameter as measured at an outer surface of the stud and a minor diameter as measured at the base of the groove, and said retaining plate having apertures arranged to correspond to the uniformily spaced studs, each said aperture having a major portion which is slideable along the length of a stud, and a minor portion communicating with the major portion which is slideable into a groove but not slideable along the stud, said minor and major portions of the apertures being arranged such that the force of gravity alone moves said retaining plate to a retaining position whereat said minor portions of said apertures rest in said grooves, when the major portions of the apertures of said retaining plate are slid along the lengths of said uniformily spaced studs to be in alignment with said grooves.

5. The hanger of claim 4, wherein said grooves in each stud have sidewalls substantially perpendicular to a central axis of the stud.

6. The hanger of claim 1, wherein said elongated backing plate is arranged to provide mounting means for mounting said hanger on a horizontally oriented surface or a vertically oriented surface.

7. The hanger of claim 1, wherein said elongated backing plate is arranged to provide mounting means for mounting said hanger on both a horizontally oriented surface and a vertically oriented surface.

8. A hanger for use in a strip door system for supporting vertically hanging flexible plastic strips, each strip having a row of uniformily spaced apertures along an upper end portion, said hanger comprising an elongated backing plate portion for mounting said hanger to a structure above an opening, a plurality of uniformily spaced cylindrically shaped studs fixed along the length of said backing plate, for supporting the plastic strips by engagement of the studs through the strip apertures, an elongated retaining plate for locking with said studs to prevent disengagement of the strips, each said stud having a plurality of annularly shaped grooves spaced along its length for locking said retaining plate with said studs by cooperation of said grooves with said retaining plate so as to provide an adjustable effective stud length between said backing plate and said retaining plate in a retaining position, and at least one retaining disc for placement in at least one of said grooves for preventing upward movement of said retaining plate from said retaining position by contact of said retaining disc with said retaining plate.

* * * * *